US008052843B2

(12) United States Patent
Snekkenes et al.

(10) Patent No.: US 8,052,843 B2
(45) Date of Patent: Nov. 8, 2011

(54) SYSTEM AND A METHOD FOR THE STEAM PRE-TREATMENT OF CHIPS IN ASSOCIATION WITH THE PRODUCTION OF CHEMICAL CELLULOSE PULP

(75) Inventors: Vidar Snekkenes, Oslo (NO); Linda Almqvist, Sundsvall (SE); Daniel Trolin, Karlstad (SE); Lennart Gustavsson, Karlstad (SE)

(73) Assignee: Metso Paper Sweden AB, Karlstad (SE)

( * ) Notice: Subject to any disclaimer, the term of this patent is extended or adjusted under 35 U.S.C. 154(b) by 658 days.

(21) Appl. No.: 12/095,131

(22) PCT Filed: Nov. 30, 2006

(86) PCT No.: PCT/SE2006/050531

§ 371 (c)(1),
(2), (4) Date: Aug. 26, 2008

(87) PCT Pub. No.: WO2007/064296

PCT Pub. Date: Jun. 7, 2007

(65) Prior Publication Data

US 2009/0301673 A1 Dec. 10, 2009

(30) Foreign Application Priority Data

Dec. 2, 2005 (SE) ..... 0502667

(51) Int. Cl.
*D21C 7/00* (2006.01)
*D21C 1/02* (2006.01)

(52) U.S. Cl. ..... 162/233; 162/68; 162/238

(58) Field of Classification Search ..... 162/68, 162/233, 238, 239, 240
See application file for complete search history.

(56) References Cited

U.S. PATENT DOCUMENTS

| | | | | |
|---|---|---|---|---|
| 5,547,546 | A * | 8/1996 | Prough et al. | 162/238 |
| 2005/0061464 | A1 * | 3/2005 | Snekkenes | 162/242 |
| 2006/0151133 | A1 * | 7/2006 | Soderberg et al. | 162/17 |

OTHER PUBLICATIONS

Burgess T., Collecting and burning noncondensible gases [downloaded online www.celso-foelkel.com.br], downloaded on May 20, 2011, section 4.2.*

Kraft Recovery Short Course Table of Contents, Mar. 14, 2005.*

Seborg et al, Process and Dynamics and Control, 2004, 2nd edition, p. 185, 198, and 216.*

* cited by examiner

*Primary Examiner* — Matthew Daniels
*Assistant Examiner* — Anthony Calandra
(74) *Attorney, Agent, or Firm* — Rolf Fasth; Fasth Law Offices

(57) ABSTRACT

The vessel in which the chips are pre-treated with steam (ST) is provided with a ventilation channel at the top of the vessel for the leading away of weak gases to a weak gas system (NCG). A simple safety system has been installed with the aim of guaranteeing that these weak gases do not reach a level of concentration at which these weak gases become explosive. The safety system has a control unit (CPU) that detects a process parameter that is indicative of the fraction of moisture in the weak gases and opens dilution lines that supply air for the dilution of the weak gases in the ventilation channel. It is appropriate that the dilution take place in stages, where the dilution lines are opened in stages with successively increasing temperature of the weak gases.

11 Claims, 2 Drawing Sheets

SYSTEM AND A METHOD FOR THE STEAM PRE-TREATMENT OF CHIPS IN ASSOCIATION WITH THE PRODUCTION OF CHEMICAL CELLULOSE PULP

PRIOR APPLICATION

This application is a U.S. national phase application based on International Application No. PCT/SE2006/050531, filed 30 Nov. 2006, claiming priority from Swedish Patent Application No. 0502667-9, filed 2 Dec. 2005.

BACKGROUND AND SUMMARY OF THE INVENTION

When manufacturing chemical cellulose pulp from chopped chips, it is desired to expel air and moisture from the chips. It is at the same time desired to heat the chips to the desired process temperature, suitably to a level around 100° C., since the chips are finally to reach a temperature of approximately 130-160° C. during the cooking process. This requires large volumes of steam, since not only is the correct chip temperature to be achieved with the aid of the steam, not only is the bound air to be expelled by the steam, but also the bound chip moisture is to be heated.

In certain older conventional systems, atmospheric chip bins have been used in which the chips are pre-heated with steam in order to expel the air. Very large volumes of withdrawn air are obtained from these systems, which volumes are contaminated with turpentine, methanol and other explosive gases that have been expelled from the chips, the latter being denoted by the term "NCGs" (where "NCG" is an abbreviation of "non-condensable gas"). If steam is used that has been obtained from the release of pressure of black liquor, this steam contains also large quantities of sulphides, known as TRS gases (where "TRS" is an abbreviation of "total reduced sulphur"), which are very malodorous. These TRS gases contain, among other compounds, hydrogen sulphide ($H_2S$), methyl mercaptan ($CH_3SH$), dimethyl sulphide ($CH_3SCH_3$), dimethyl disulphide ($CH_3SSCH_3$), and other strongly malodorous gases. Hydrogen sulphide and methyl mercaptan, which principally come from the steaming of black liquor, have boiling points of −60° C. and +6° C., respectively, and it will thus be difficult to condense these compounds out from the gases.

Pure steam is often used for heating in the chip bin in order to minimise the release of TRS gases, and black liquor steam is used first in the subsequent steam-treatment step that follows the chip bin. Even if black liquor steam is used only in a subsequent steam-treatment step, it is still possible that these TRS gases leak up into the chip bin or are deliberately allowed to escape up into this chip bin during, for example, interruptions in operation.

Systems are revealed in U.S. Pat. No. 6,375,795 and in U.S. Pat. No. 6,284,095 in which it is attempted to disperse TRS gases from a pressure isolation device arranged between a chip bin and a steam-treatment vessel, where the TRS gases are withdrawn from the pressure isolation device and reintroduced at a position that lies downstream in the input sequence, at the outlet end of the steam-treatment vessel. The system has a chip bin arranged upstream, and a ventilation system is arranged at this bin in order to deal with weak gases. The system also provides possibilities for the dispersion of the TRS gases on certain occasions, either at a standpipe into the atmosphere, or to lead these TRS gases to the superior chip bin. Both of these alternatives involve the risk that TRS gases leak into the surroundings and create odour problems. The dispersal of pressurised TRS gases from the pressure isolation device, however, is combined with problems, since chips and fragments of chips can readily become stuck in the system, resulting is malodorous TRS gases being released up into the chip bin.

The prior art technology has identified the problem that it is desired to minimise leakage of harmful and toxic gases that arise during the steam pre-treatment with hot steam. It is normal to allow removal of weak gases from the chip bin to a destruction system, and to allow a further dispersal of gases from the steam pre-treatment vessel, the latter often being considered to be strong gases. It is attempted to maintain the concentration of the weak gases at well under 4% by volume, and the concentration of the strong gases at well over 40% by volume.

In the previously known chip bins in which steam is blown into the bed of chips, large volumes of weak gases are formed, and either pure steam or special systems that manage to deal with these weak gases are required. It is a property of weak gases that they very readily obtain a very explosive composition. As long as the concentration of NCGs lies lower than approximately 4% by volume or well over 40% by volume, there is no risk of explosion. For this reason, weak gas systems that maintain the concentration below under 4% by volume, typically below 1-2% by volume, or strong gas systems that maintain the concentration well over 40% by volume are used. It is thus ensured that the concentration in weak gas systems is held well below 4% by volume, and this entails the transport of large volumes of air: as soon as the volume of NCGs is set to increase, an equivalent increase in the fraction of air must be carried out in order to maintain the concentration below the critical limit.

If, for example, 1 kg/min of NCGs are steamed off in a chip bin, the air amount must lie around approximately 50 kg/min in order to maintain the concentration at approximately 2% by volume. If an increase in the NCGs to 2 or 3 kg/min takes place, as may occur in certain interruptions in the process, it is necessary temporarily to increase the amount of air to 100 or 150 kg/min. This results in the system being normally dimensioned such that it can deal with the normal flow, and that excess gases are vented directly into the atmosphere through the vent pipe when interruptions in operation occur.

Another solution to minimise the volumes of weak gases is to control the flow of chips through the chip bin such that a stable plug flow through the chip bin is obtained, and the supply of steam to the chip bin is in this case controlled such that only the chips in the lower part of the bin are heated. This technique is known as "cold-top" control and is applied in systems that are marketed by Kvaerner Pulping AB under the name DUALSTEAM™ bin.

A number of very expensive solutions have been developed in order to reduce the explosiveness and toxicity of the weak gases. Different systems are revealed in, for example, WO 96/32531 and in U.S. Pat. No. 6,176,971, in which cooking fluid withdrawn from the digester generates pure steam from ordinary water. The use of totally pure steam for the steam pre-treatment of the chips reduces the TRS content in the weak gases, since the steam used is totally free from any TRS content.

These systems, however, inevitably give rise to energy losses and additional expensive process equipment.

The principal aim of the invention is to obtain a chip bin or similar vessel for the steam pre-treatment of chips in which the risks of leakage of weak gases are minimised and that is not associated with the disadvantages of the prior art.

A second aim is to obtain a safe system with simple regulation in which it is ensured that the weak gases that are drawn from the chip bin always maintain a concentration of TRS gases (or of NCGs) that lies well below the level at which the mixture of gases becomes explosive.

The system uses a simple temperature regulation, in which, with increasing temperature of the weak gases, a gradually increasing amount of dilution air is added at the ventilation channel in which the weak gases are transferred to the destruction system or the DNCG system (where "DNCG" is an abbreviation for "diluted NCG").

A further aim is to use a condensation arrangement in the weak gas system such that the gas volumes can be reduced early in the weak gas system, in which way an effective reduction in the volumes of weak gases can be achieved if large flows of steam are suddenly emitted from the top of the chip bin, and to avoid in this manner the customary venting to atmosphere. Current weak gas system are normally dimensioned such that they are able to deal with a nominally interruption-free flow of exhaust gases, and not to be able to deal with the increased volume of NCGs that may temporarily arise in the event of an interruption in operation. The volumes of gases obtained during such interruptions of operation are much larger than those that the weak gas system can manage, and the extra gas volume has, in general, been emitted to the surrounding air, through a dispersal standpipe of the roof of the mill, which has had as a consequence that the pulp mill has been compelled to emit malodorous gases.

A further aim is that the safety system is preferably used during what is known as "cold-top"-regulation of the heating of the chips, in which the chips are heated in such a manner that a temperature gradient is formed in the volume of chips, where the chips at the top of the chip bin maintain a temperature of approximately 40° C., and successively higher temperatures down towards the bottom of the chip bin are established with an advantageous temperature of approximately 90-110° C. established at the bottom of the chip bin. This system ensures that the volumes of gases that are expelled from the chips in the chip bin are very low, and the load on the weak gas system will be minimal during continuous routine operation. The system does, however, possess the property that NCGs tend to accumulate in a condensation layer in the chip bin, and in the event of steam break-through, when the chips reach a temperature of well over 40° C. at the top of the chip bin as a result of interruptions in the system, large amounts of NCGs are expelled from the bed of chips, which amounts must be dealt with by the weak gas system.

DETAILED DESCRIPTION OF PREFERRED EMBODIMENTS

Figure 1:
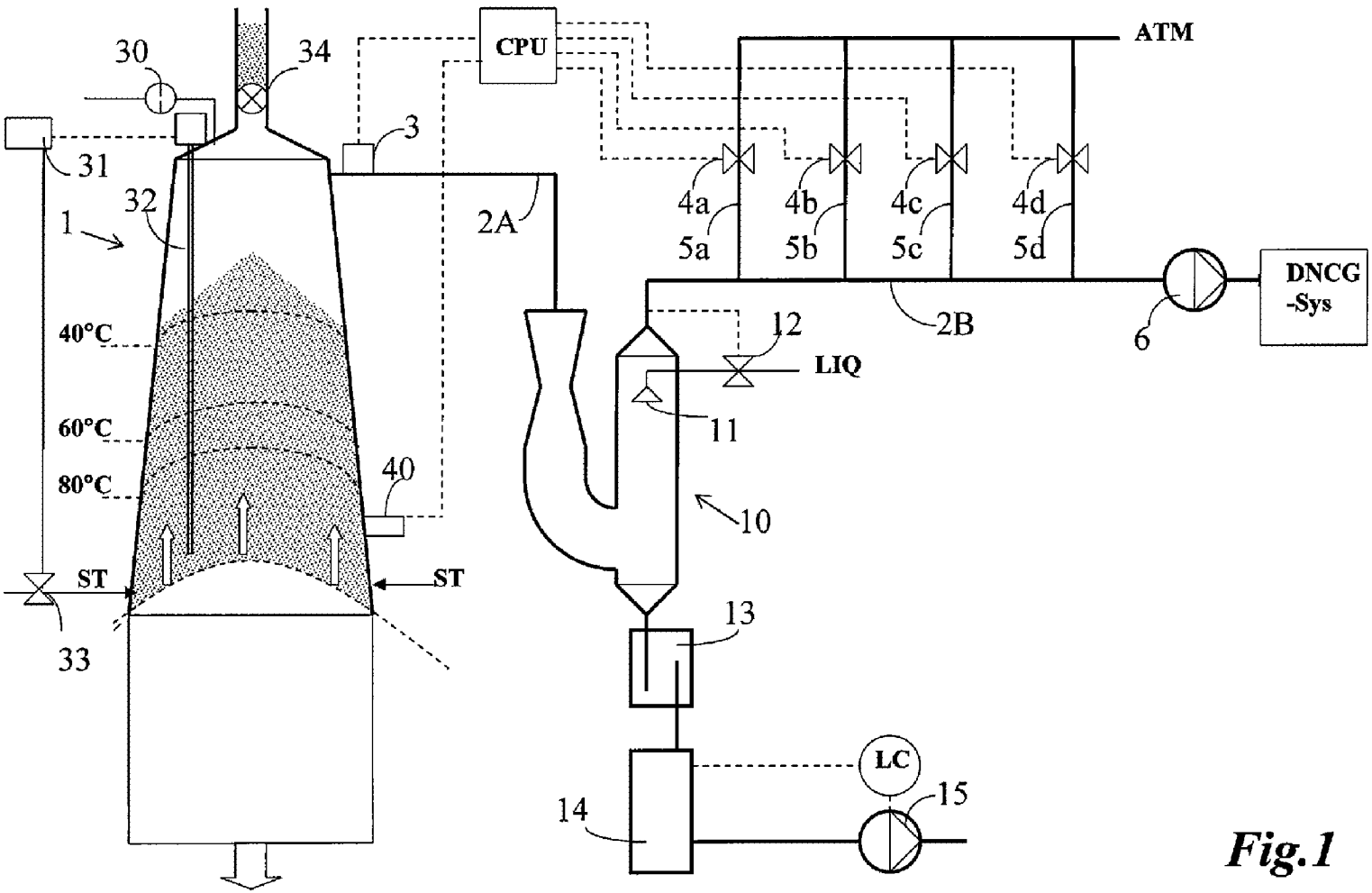
FIG. 1 shows schematically a system for the steam pretreatment of chips according to the invention.

FIG. 1 shows schematically a suitable vessel, shown here as a chip bin 1, into which chopped chips are fed in to the top of the chip bin through a flow feed or input feed 34. A upper level of chips is normally established at the top of the chip bin such that this level is established between a lowest and a highest level. Gas phase is established in the vessel between this upper chip level and the top of the vessel.

The vessel may also be a vessel in which impregnation of the chips takes place in the lower part of the vessel, according to, for example, a technology sold by Kvaerner Pulping AB under the name IMPBIN™.

Steam ST is added at the lower part of the chip bin well below the established upper chip level through suitable addition nozzles, where the amount of steam is regulated by detecting the temperature in the column of chips. A measurement probe 32 is used in the drawing, which probe establishes a mean value along a long stretch of the measurement probe, and its output signal is led to a control unit 31 that regulates the valves 33 on the steam supply line.

The steam may preferably be pure steam totally free of any NCG and TRS content, or it may be black liquor steam, which contains TRS.

The chips are pre-treated in the embodiment shown according to the "cold-top" concept, in which it is attempted to establish a temperature gradient in the chip bin, shown schematically, where different levels of temperature: 80° C., 60° C., and 40° C., are established upwards in the column of chips. In the ideal case, the chips at the upper surface of the column of chips are to maintain a temperature in the interval 20-40° C.

A ventilation channel 2A-2B for venting of the weak gases that are formed is arranged at the upper part of the vessel and connected to a weak gas system NCG in which these weak gases are evacuated with a suitable fan 6 (or pump).

In the embodiment shown in FIG. 1, also a temperature sensor 3 installed for the weak gas system is used to detect the temperature in the upper part of the vessel. The temperature sensor here is located in the ventilation channel 2A close to the upper part of the vessel, typically less than 1 metre from the vessel 1, but it is possible to use also a temperature sensor that is located within the top of the vessel, or to use the temperature sensor 32.

The ventilation channel 2A-2B is according to the invention connected to at least one diluting air input line 5*a*, 5*b*, 5*c*, 5*d*, that is connected to the surrounding atmosphere ATM at one end and connected at its other end to the ventilation channel 2B through a valve 4*a*, 4*b*, 4*c* and 4*d*.

A control unit CPU is connected to the temperature sensor 3 and to the relevant valves 4*a*, 4*b*, 4*c* and 4*d* in the dilution lines 5*a*, 5*b*, 5*c* and 5*d*, which control unit CPU opens and closes the relevant valves when the temperature exceeds predetermined threshold values that are set and stored in the control unit.

Four dilution lines 5*a*-5*d* are shown in the drawing, but it is preferable that at least two dilution lines 5*a*, 5*b* are connected to the ventilation channel 2B, with first 4*a* and second 4*b* valves in the associated dilution lines 5*a* and 5*b*, and where the control unit opens the relevant valve when a first or second threshold value is exceeded. The first threshold value is a pre-determined first temperature $T_{level1}$ and the second threshold value is a pre-determined second temperature $T_{level2}$, where $T_{level1}<T_{level2}$.

The system can be extended with a suitable number of dilution lines where a third dilution line 5*c* with a third valve 4*c* is connected to the ventilation channel 2B, and where the control unit opens the third valve 4*c* when a third threshold value $T_{level3}$, where $T_{level1}<T_{level2}<T_{level3}$, is exceeded, etc.

In order to limit the volumes of weak gases in the subsequent handling, the system is provided with a suitable condensation arrangement 10 connected to the ventilation channel 2A, 2B between the vessel 1 and the connections of the ventilation lines to the ventilation channel 2B. A condensate is withdrawn from the condensation arrangement in a condensation line with a pump 15. This condensation arrangement can comprise condensation technology in which cold process fluid LIQ (typically condensate from the pulp mill) or cold water is sprayed into the gas flow through a suitable distribution nozzle 11. The amount of added cold fluid for the condensation is controlled, by use of the valve 12, depending on the temperature detected in the gas outlet from the condensation arrangement. Typically, it is attempted to maintain this temperature at the outlet at approximately 40-45° C., and for this reason essentially all water vapour can be separated, and a certain amount of other readily condensable gases that are malodorous (although not the more malodorous TRS gases to any major extent). The condensation technology means that the complete channel system that lies downstream of the condensation arrangement can adapt to much lower volumes of gas, something that is important from an economic point of view since these weak gases are often led along large distances either to a soda boiler or to another destruction plant at a considerable distance from the chip bin.

The condensation arrangement is important in order to remove steam from the air flow that is withdrawn, such that there is no risk that steam condenses in lines or vessels that are located downstream, something that can involve the flow of gases achieving a raised concentration of NCGs in the remaining gas flow, i.e. that the gas concentration comes to lie within the interval where a risk for explosion arises: 4-40% by volume.

The condensation arrangement in the drawing has a pressure lock 13 for condensate in its outlet, appropriately a simple water lock, from which condensate is led to a buffer tank 14, from which the malodorous condensate can be pumped by the pump 15 onwards to destruction, the pump typically being controlled by the level in the buffer tank 14.

The valves 4*a*-4*d* on the air dilution lines 5*a*-5*d* are preferably valves of a binary type that switch from a fully open condition to a fully closed condition, where the fully open condition is selected if the control signal from the control unit disappears, to give a "fail-safe mode".

Figure 2:
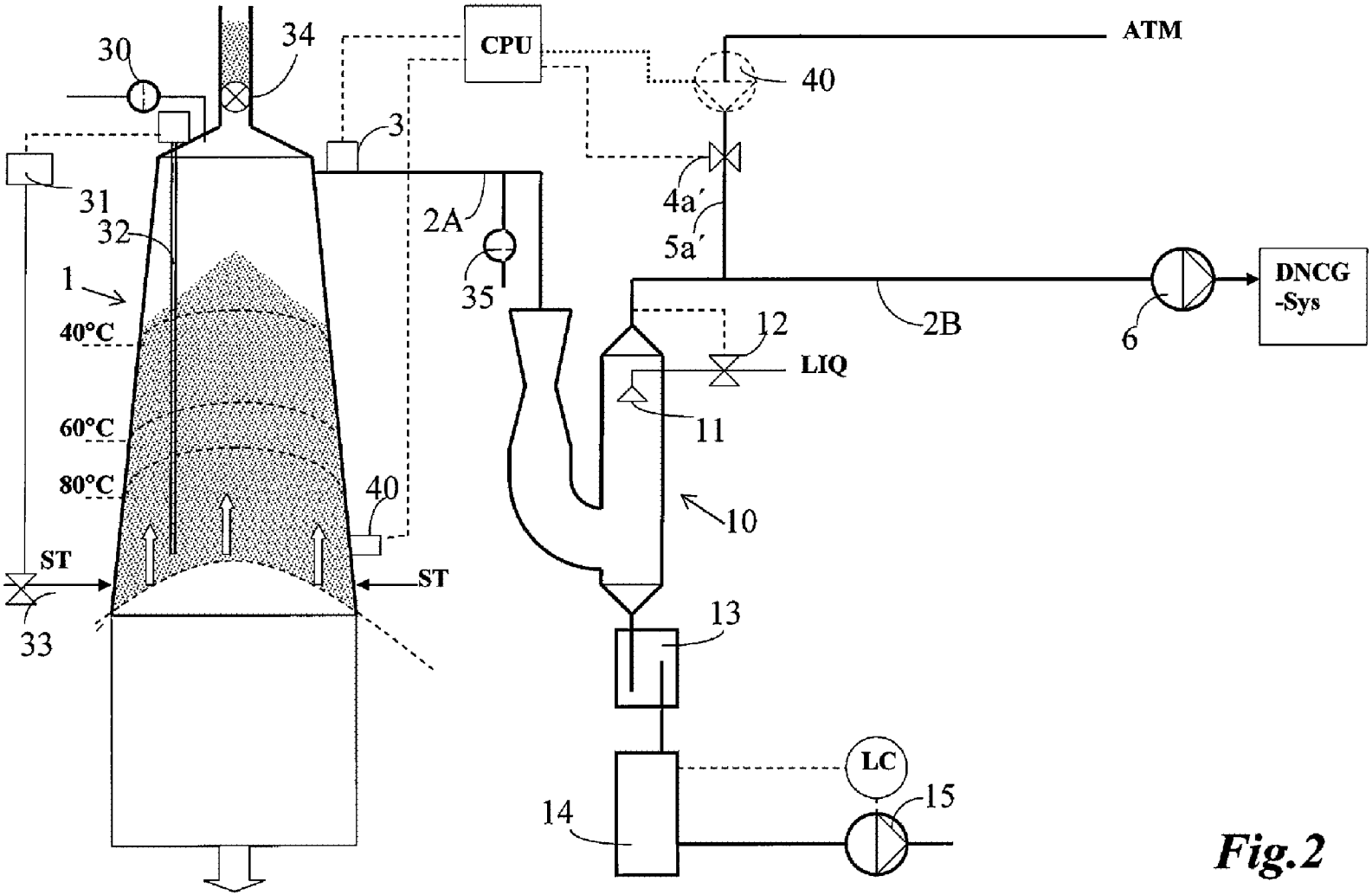
FIG. 2 shows a variant of the invention.

FIG. 2 shows a variant of the system according to FIG. 1, where the valve in the dilution line 5*a* is a proportional valve, instead, whose degree of opening can be set proportionally between a fully open condition and a fully closed condition, proportional to the control signal from the control unit, where the fully open condition is selected if the control signal from the control unit disappears. It is also suggested in this drawing that it is possible to have a pressurising fan 40 in the dilution lines in order to feed in dilution air. The fan 40 must, in this case, have a capacity that lies well under the suction capacity of the fan 6 in order to avoid the risk of pressurising the chip bin.

The system according to FIG. 1 functions in the following manner. When the air withdrawn from the chip bin maintains a temperature of up to 60° C., measured by the sensor 3, this air maintains a maximum of 20% by volume of water vapour, and a concentration of approximately 2% by volume of NCGs is maintained in the remaining 80% by volume, i.e. the fraction of NCGs in the total volume (including steam) is approximately 1.6% by volume. Even if the water vapour were to be condensed out, the concentration of NCGs would not exceed 2% by volume during normal interruption-free operation, and this is well under the critical level of 4% by volume. This condition is the one that is normally established during "cold-top" regulation of the steam pre-treatment, and there is normally no risk of explosion.

However, in order to ensure a low concentration in the weak gases, the system opens a first valve 4*a* when the temperature lies within the interval 40-60° C. Operational conditions may arise in which NCGs, or even TRS gases, force their way up through the chip bin, and it is for this reason desired to establish a safety margin to prevent the establishment of a critical concentration.

When the temperature reaches 80° C., the air that has been withdrawn from the chip bin (the undiluted air) maintains a maximum of approximately 48% by volume water vapour. This means that the fraction or concentration of NCGs in the remaining volume of gas, excluding the water vapour, increases from 2% by volume to just over 3% by volume, on the condition that the total fraction of NCGs is constant. However, since more NCGs are expelled from the chips by through-ventilation of steam, it has proved to be the case that the fraction of NCGs in the volume of gas, excluding the water vapour, lies rather close to the critical level of 4% by volume.

In order to prevent this critical level from being reached at a temperature of up to 80° C., the system opens a second valve 4*b* when the temperature reaches 60° C., such that the critical concentration cannot be established in the temperature interval 60-80° C.

When the temperature reaches 95° C., the air that is withdrawn from the chip bin, if no diluting air has been added, contains a maximum of approximately 85% by volume water vapour. This means that the fraction or concentration of NCGs in the remaining volume of gas, excluding water vapour, increases from 2% by volume to just over 10% by volume, on the condition that the total fraction of NCGs is constant. In order to prevent this level being reached at a temperature of up to 95° C., the system opens also a third valve 4*c* when the temperature reaches 80° C., such that the critical concentration cannot be established in the temperature interval 80-95° C.

If the temperature exceeds 95° C. and reaches 100° C., the air that is withdrawn from the chip bin, if no diluting air has been added, contains a maximum of approximately 100% by volume water vapour (at 100° C. and at atmospheric pressure). In order to prevent the critical concentration from being reached at a temperature of over 95° C., the system opens also a fourth valve 4*d* when the temperature exceeds 95° C., such that the critical concentration cannot be established in the temperature interval 95-100° C.

The activation of the various valves by the system can be seen in the following table:

| TC1 | Valve 4a | Valve 4b | Valve 4c | Valve 4d | TC2 |
|---|---|---|---|---|---|
| 40° C. | open | closed | closed | closed | 40° C. |
| 60° C. | open | open | closed | closed | 45° C. |
| 80° C. | open | open | open | closed | 45° C. |
| 95° C. | open | open | open | open | 45° C. |

where TC1 is the temperature measured by sensor 3, and where TC2 is the temperature that the condensation arrangement 11 uses to control the cooling flow.

A calibrated flow of dilution air is established at each stepwise opening of the valves 4*a*-4*d*, appropriately through a calibrated throttle, or through the design of the relevant valve, such that given falls in pressure and flow are established that ensure a sufficient supply of dilution air, such that the concentration is held at a low value. The negative pressure in the ventilation channel 2B is maintained at a given level by the fan 6 in a conventional manner (pressure control).

This example of temperature-controlled activation of the valves enables it to be realised that the system as an alternative or as a complement, may have direct measurement of the moisture content of the gases. Moisture sensors, however, are more liable to disturbance and are not in any way as stable as a simple temperature sensor. The concept of "gas sensor" in this application applies to both a temperature sensor and a moisture sensor.

The system and the method can be supplemented also with measurement of the level of chips in the vessel, detected by means of a level sensor 40, also which signal from the level is led to the control unit CPU. In addition to the controlled regulation of the added dilution air as a function of moisture level or temperature, the amount of dilution air that is added can be regulated also by the current level of chips. It is appropriate that this regulation starts to apply when the level falls below a certain pre-determined minimum level, where the risk of penetration of, primarily, TRS gases can arise if the volume of chips becomes too low. As the chip level successively falls under this minimum level, successively increasing amounts of dilution air can be added in a similar manner as that which occurs with an increasing fraction of moisture or an increasing temperature in the gas phase of the vessel.

For example, a valve can be opened in the system if the level lies below this minimum level, and a further valve can be opened if the level subsequently falls even further, for example to 90% of the minimum level, etc.

If both the level of chips and the level of moisture or temperature indicate that addition of dilution air is necessary, the current level of added dilution air may be larger than that that would be added if only one of these parameters controlled the degree of opening of the valves.

The system displayed in FIG. 2 can be regulated in a similar manner, where the valve 4*a'* is used as a proportional valve with a fall in pressure that can be regulated, where the degree of opening of the valve provides a proportional flow of dilution air, either through the dilution air being supplied at an amount that is proportional to the current temperatures or in stepwise addition corresponding to the functionality of the system shown in FIG. 1.

The invention can be varied in several ways within the scope of the attached patent claims. For example, the valves in the embodiment shown in FIG. 1 can be opened at different temperature levels, and there may be a greater or lesser number than the four that are shown in this embodiment.

The first valve 4*a* can be also a fixed throttle that is held always open, in the same way as the valve 30 or the valve 35, and where only valves 4*b*, 4*c* and 4*d* are regulated by the control unit between their closed and open conditions depending on the current temperature.

The condensation arrangement may be also of another type than one that functions through directly condensing fluid; one with, for example, indirect cooling in a heat exchanger or with electrical cooling elements (Peltier elements, etc).

One alternative is that the valves 4*a*-4*d* are instead proportional valves whose degree of opening can be proportionally set between a fully open position and a fully closed position, the proportionality being to the control signal from the control unit, where the fully open condition is selected in the event that the control signal from the control unit disappears.

The system and the method can, naturally, be used also in steam pre-treatment systems using what is known as "hot-top" regulation, in which the steam is added in such an amount that steam continuously blows through the complete volume of chips in the vessel.

The feed arrangement of the vessel may be of different types, such as a simple chip feed with rotating bins (shown schematically in the drawing), or various feed screws that are often placed into a horizontal housing, with or without reverse valve means in the inlet.

While the present invention has been described in accordance with preferred compositions and embodiments, it is to be understood that certain substitutions and alterations may be made thereto without departing from the spirit and scope of the following claims.

The invention claimed is:

1. A system for the steam pre-treatment of chips in association with the production of chemical cellulose pulp, comprising:

a vessel having an inlet defined therein at a top of the vessel into which chips are fed into the vessel, the vessel having an outlet defined therein at a bottom of the vessel from which treated chips are fed out from the vessel, a feed arrangement for feeding chips to the vessel such that the chips in the vessel establish an upper chip level between the inlet and the outlet, and a gas phase between the upper chip level and the top of the vessel, at least one nozzle for supplying steam (ST) being arranged in the vessel, the at least one nozzle having an outlet defined therein below the upper chip level, a ventilation channel arranged in an upper part of the vessel and connected to a weak gas system, a gas sensor for detecting a process parameter in the upper part of the vessel, the process parameter being directly or indirectly indicative of a fraction of moisture in the gas phase of the vessel, at least one dilution line connected to the ventilation channel, a first end of the dilution line being in fluid communication with a surrounding atmosphere (ATM) and a second end of the dilution line being in fluid communication with the ventilation channel through a valve, and a control unit (CPU) in operative engagement with the gas sensor and to the valve in the dilution line, the control unit being adapted to open the valve when the process parameter exceeds a pre-determined threshold value wherein a condensation arrangement is connected to the ventilation channel between the vessel and connections of the dilution lines to the ventilation channel.

2. The system according to claim 1, wherein the gas sensor is a temperature sensor.

3. The system according to claim 2, wherein at least two dilution lines are connected to the ventilation channel, through a first valve and a second valve in the dilution line and where the control unit (CPU) is adapted to open a valve when a first and a second threshold are exceeded.

4. The system according to claim 3, wherein a third dilution line with a third valve are connected to the ventilation channel, and the control unit (CPU) is adapted to open the third valve when a third threshold is exceeded.

5. The system according to claim 1, wherein the valve in the dilution line is a binary valve that switches between a fully open condition and a fully closed condition, wherein the fully open condition is selected if a control signal from the control unit disappears.

6. The system according to claim 1, wherein the valve in the dilution line is a proportional valve having a degree of opening between a fully open condition and a fully closed condition in proportion to a control signal from the control unit, wherein the fully open condition is selected if the control signal from the control unit disappears.

7. The system according to claim 1 wherein the upper level of chips in the vessel is detected by a level sensor and wherein the control unit is connected to the level sensor and the control unit opens at least one valve connected to the ventilation channel depending on a sinking level.

8. A method for steam pre-treatment of chips in association with the production of chemical cellulose pulp, comprising:

continuously feeding chips in to a top of a vessel for establishing a column of chips within the vessel between the top and a bottom of the vessel, supplying steam (ST) to the column of chips to pre-treat the chips, feeding out the pre-treated chips from the bottom of the vessel, removing gases at the top of the vessel, the gases having been expelled from the chips and containing steam, air and non-condensable gases, detecting a process parameter that is indicative of a fraction of moisture in the gases at the top of the vessel, adding dilution air to the gases that are being removed from the top of the vessel as a function of the detected process parameter, and increasing an amount of dilution air with an increasing fraction of moisture in the gases wherein the gases that are led away from the top of the vessel are subject to a condensation before the addition of the dilution air.

9. The method according to claim 8, wherein the process parameter is equivalent to a current temperature of the gases at the top of the vessel and the amount of dilution air increases with increasing temperature of the gases.

10. The method according to claim 9, wherein the addition of dilution air takes place in steps, wherein a first given amount of dilution air is added to the gases when a temperature reaches a first level, and wherein a second given amount of dilution air is further added to the gases when the temperature reaches a second level, the second level is a higher temperature level than the first level.

11. The method according to claim 8 wherein the upper level of chips in the vessel is detected and dilution air is added to the gases that are led away from the top of the vessel as a function of a current level of chips, wherein an amount of dilution air increases with decreasing level of chips.

* * * * *